US007234993B2

(12) United States Patent
Lin

(10) Patent No.: US 7,234,993 B2
(45) Date of Patent: Jun. 26, 2007

(54) BRA CUPS HAVING WAVE-SHAPED EDGE

(76) Inventor: Shian Yi Lin, No. 138, Sirong St., West District, Chiayi City (TW) 60041

( * ) Notice: Subject to any disclaimer, the term of this patent is extended or adjusted under 35 U.S.C. 154(b) by 0 days.

(21) Appl. No.: 11/189,694

(22) Filed: Jul. 27, 2005

(65) Prior Publication Data

US 2006/0025042 A1 Feb. 2, 2006

(30) Foreign Application Priority Data

Jul. 28, 2004 (TW) ..... 93211949 U

(51) Int. Cl.
*A41C 3/04* (2006.01)
*A41C 3/12* (2006.01)

(52) U.S. Cl. ..... 450/1; 450/57; 450/54

(58) Field of Classification Search ..... 450/54, 450/58, 1, 64, 65, 72, 73, 74, 88, 86
See application file for complete search history.

(56) References Cited

U.S. PATENT DOCUMENTS 2,883,988 A * 4/1959 Lee ..... 450/46
4,995,847 A * 2/1991 Hwang ..... 450/71
5,957,748 A * 9/1999 Ichiha ..... 450/58
6,165,047 A * 12/2000 Scott et al. ..... 450/55

* cited by examiner

*Primary Examiner*—Gloria M. Hale
(74) *Attorney, Agent, or Firm*—Rosenberg, Klein & Lee

(57) ABSTRACT

A bra includes two cups and each cup is connected with a side wrap and has a connection portion for connecting a shoulder strap which is connected to the side wrap. Each cup has a protrusion protruding from a top edge thereof so as to cover the nipple of the wearer and at least one concave portion is defined between the protrusion and the connection portion. The concave portion eliminates the stress on the top edge of each cup so as to reduce the pressing force to the breast.

10 Claims, 13 Drawing Sheets

BRA CUPS HAVING WAVE-SHAPED EDGE

FIELD OF THE INVENTION

The present invention relates to a bra cup that includes a protrusion for covering the nipple and a concave portion connected between the shoulder strap and the protrusion so as to release stress to the breast.

BACKGROUND OF THE INVENTION

A conventional bra 2 is shown in FIG. 12 and generally includes two cups 21 each are connected to a side wrap 23 and a shoulder strap 22 which is connected to a connection portion 211 between the cup 21 and the shoulder strap 22. It is noted that each cup 21 includes a top edge 212 which is an upward inclined edge extending from one end of the cup 21 to the connection portion 211. As shown in FIG. 13, when wearing the bra 2, the shoulder straps 22 pull the cups 21 upward to support the breasts in the cups 21. However, the top edge 212 tends to press the breast and to squeeze the top portion of the breast as shown by arrows in FIG. 14. This is not a healthy way to wear a bra and the top edge 212 forms an obvious line when wearing a T-shirt. This could happen to any wearer, especially during female period or period of pregnancy which makes the breasts larger.

Besides, for a maternity bra, as shown in FIG. 15, the cups 21 each have a hole 211 and a piece of cover 212 is attached to a lower edge of each cup 21 so as to cover 212 the hole 211. A hook member 26 is connected to a top end of the cover 212 so as to be hooked to a member 25 on the shoulder strap 22 to position the cover 212. Therefore, the mother can conveniently unhook the cover 212 to feed the baby without take off the bra. In addition, an extension part 24 can be added between two connection ends of the side wraps 23 so as to adapt wider body. Again, the cups 21 include the same top edges that compress the breasts and the extension part 24 cannot change the size of the cups 21 so that the inherent problems cannot be resolved.

The present invention intends to provide a bra wherein each cup have a wave-shaped top edge so as to eliminate the pressing force applied by the top edge of each cup.

SUMMARY OF THE INVENTION

The present invention relates to a bra that comprises two cups connected with each other at two respective insides thereof and two side wraps extend from two respective outsides of the two cups. Each cup has a connection portion for connecting the shoulder strap and a shoulder strap is connected between the connection portion and the side wrap. Each cup has a protrusion protruding from a top edge thereof for covering the nipple and at least one concave portion is defined between the protrusion and the connection portion.

The primary object of the present invention is to provide a bra that reduces pressing force at the top edge of each cup to the breast.

Another object of the present invention is to provide a bra that is also used as a maternity bra, and the nipples can be easily accessible to the baby by simply folding the protrusions outward.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
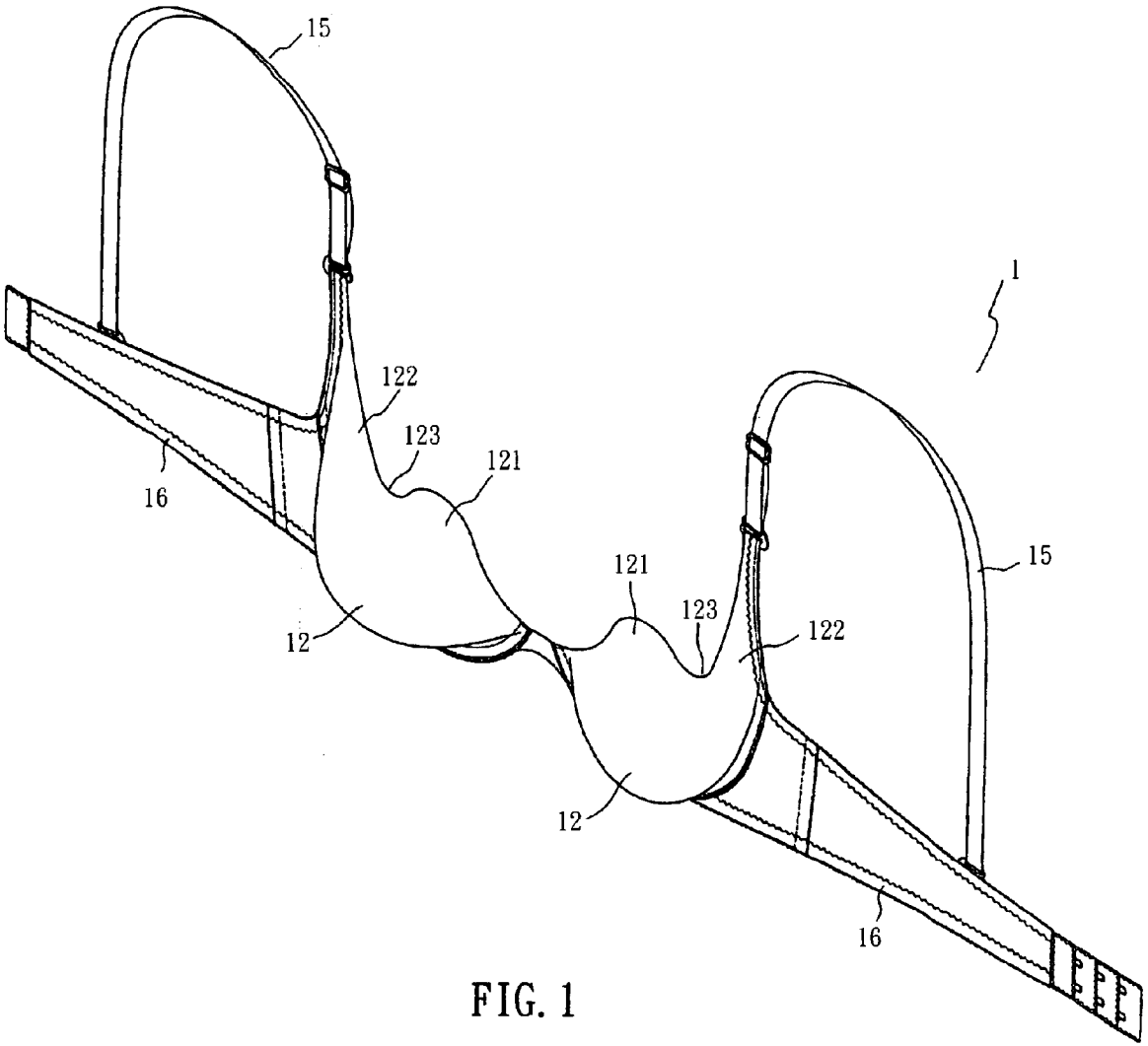
FIG. 1 is a perspective view to show the bra of the present invention.

Referring to FIGS. 1 to 5, the bra 1 of the present invention comprises a two cups 12 connected with each other at two respective insides thereof and two side wraps 16 extend from two respective outsides of the two cups 12. Each cup 12 has a connection portion 122 on a top thereof and a shoulder strap 15 connected between the connection portion 122 and the side wrap 16. The cups 12 are madev by resilient and soft material.

Figure 2:
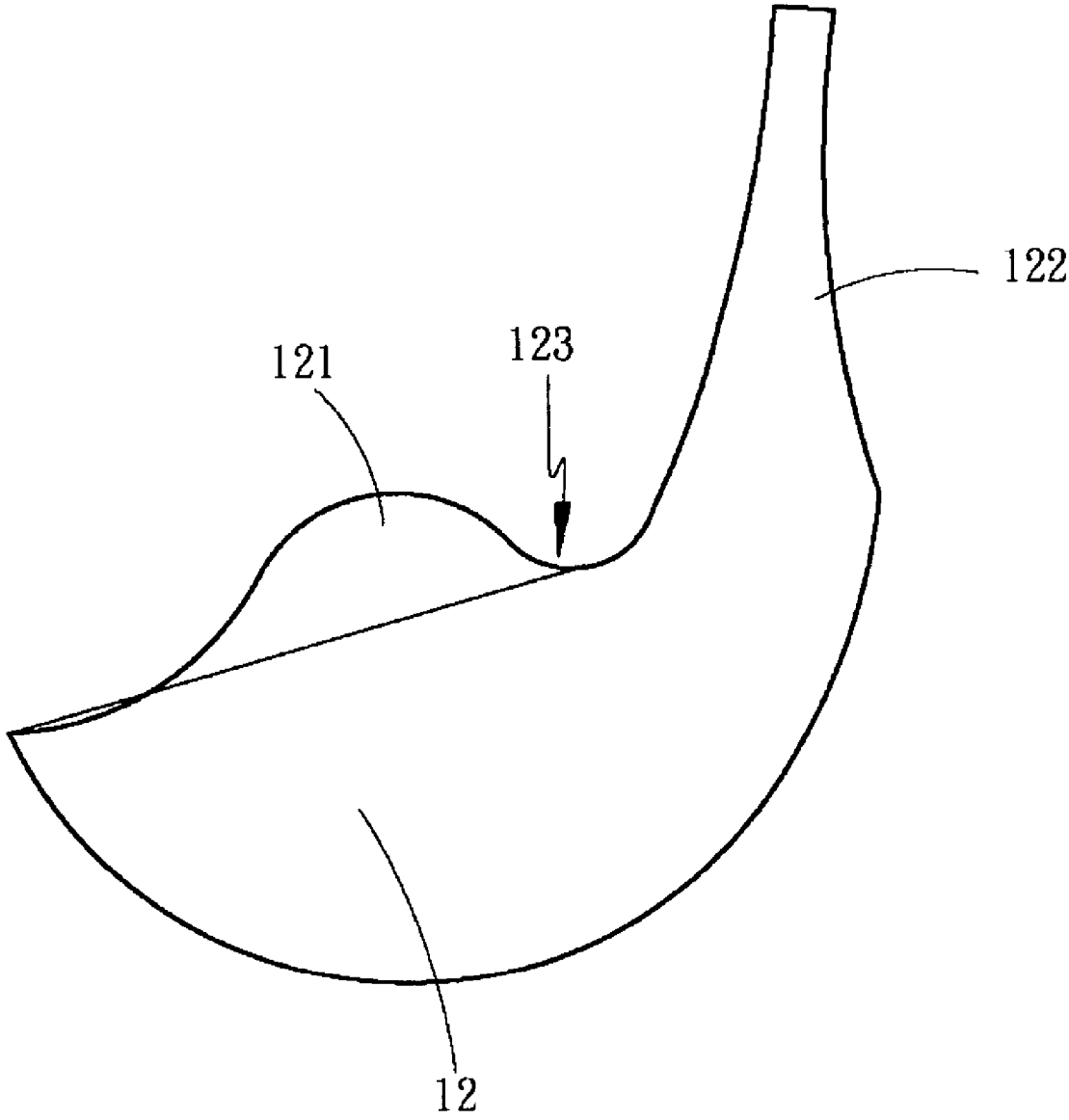
FIG. 2 shows that a bottom point of the concave portion of each cup and a lowest point of the inside of each cup is located on a straight line.
Figure 3:
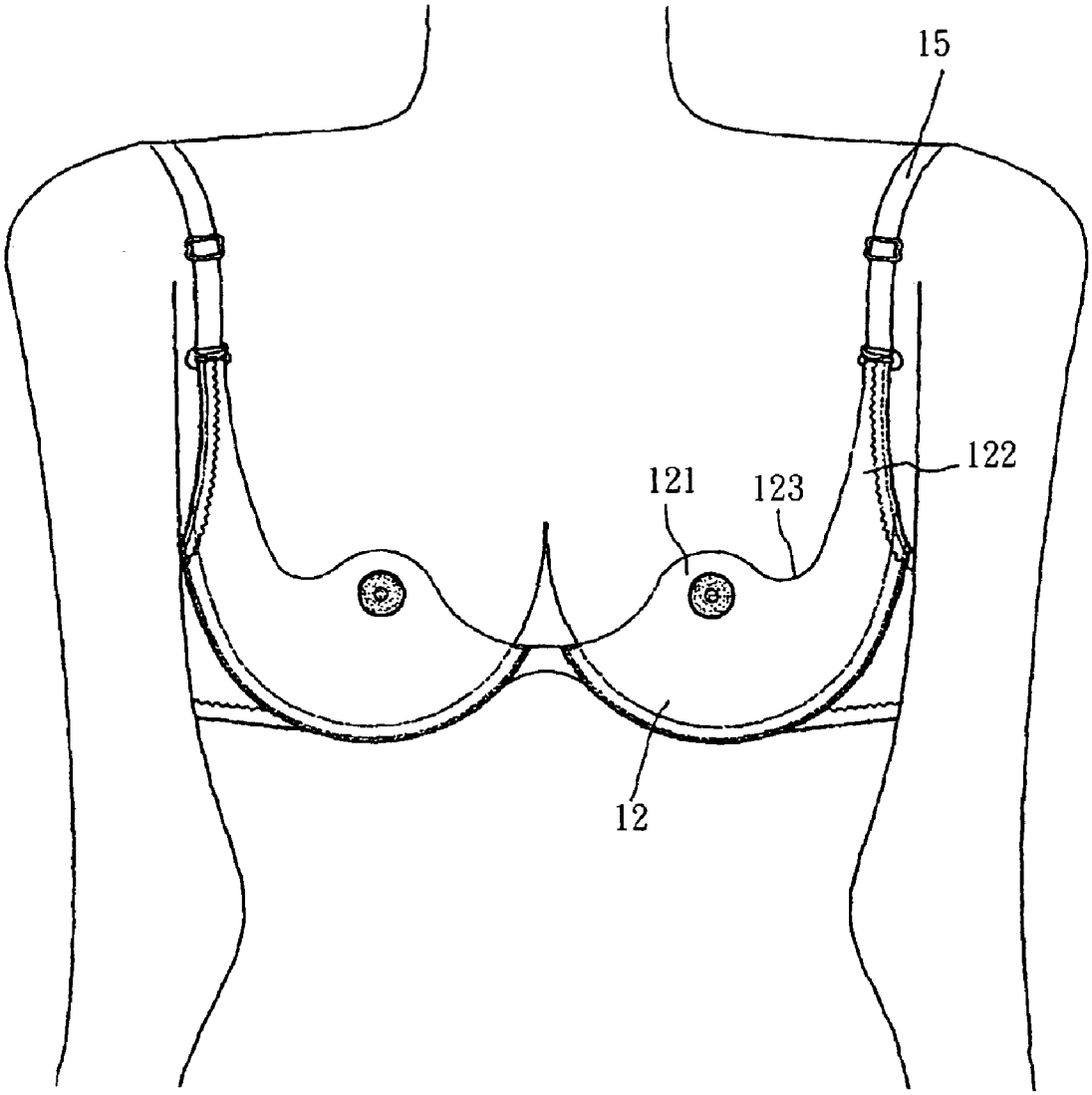
FIG. 3 shows that the protrusions of the cups cover the nipples of the wearer.
Figure 4:
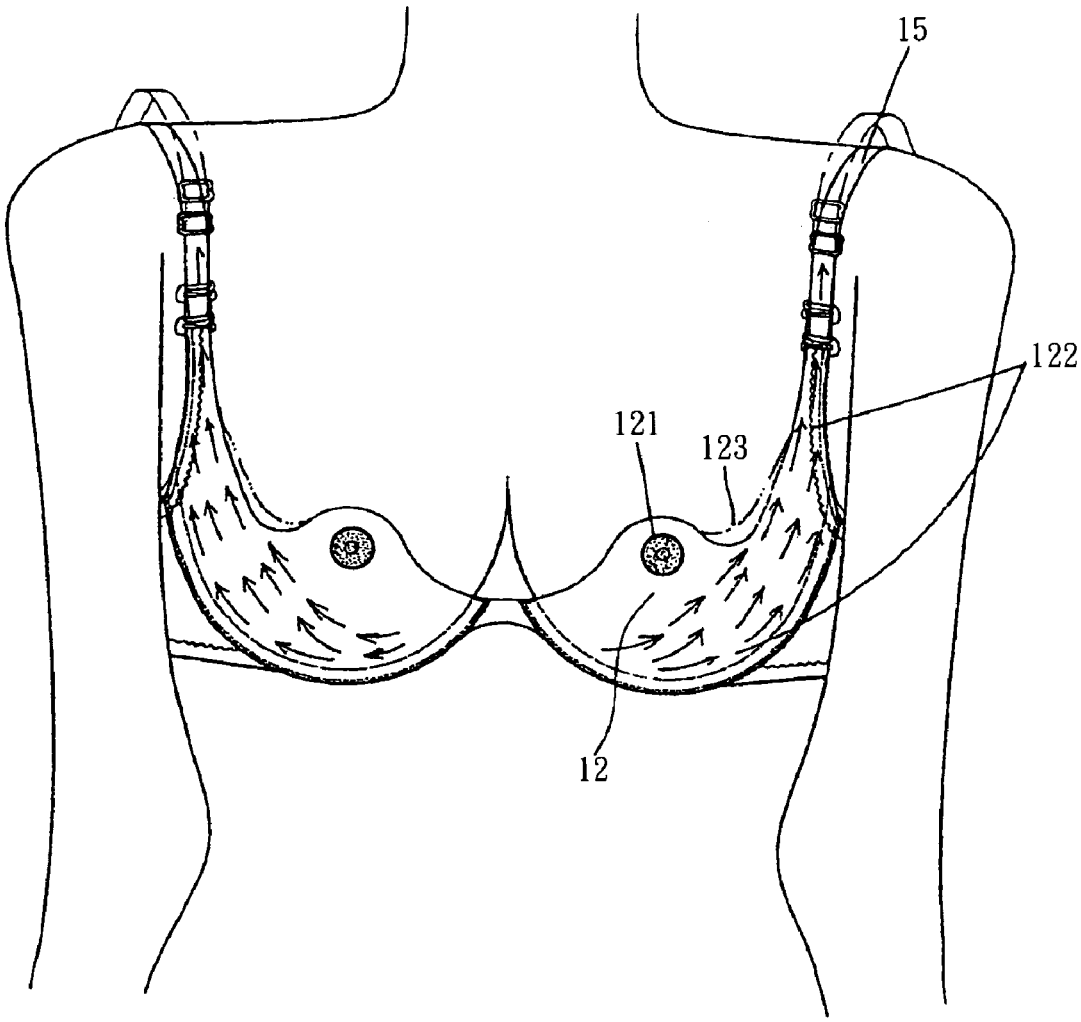
FIG. 4 shows that the concave portions reduce the pressing force to the breasts.
Figure 5:
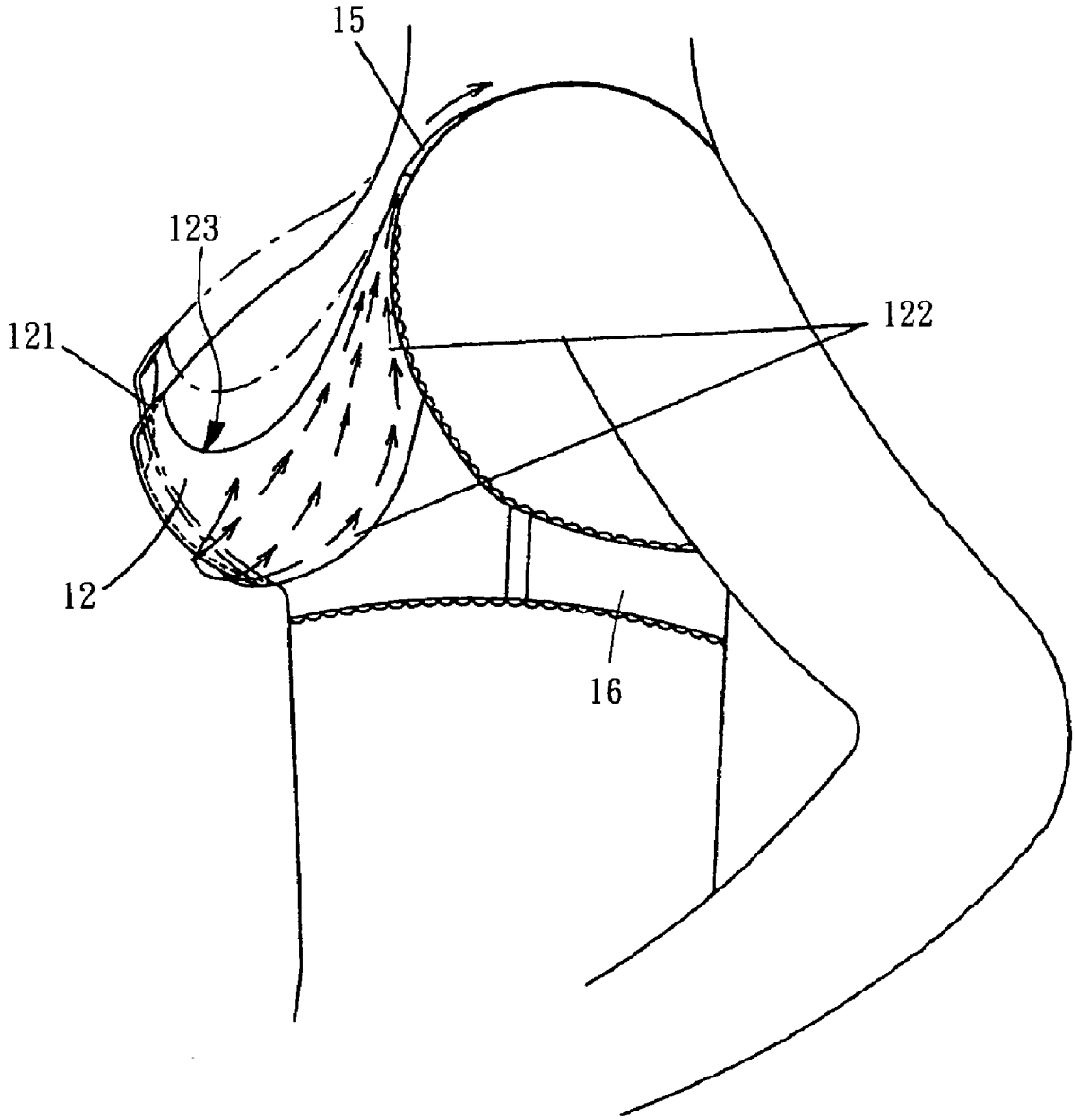
FIG. 5 shows that the breasts are raised by wearing the bra of the present invention.

Each cup 12 has a protrusion 121 protruding from a top edge thereof and at least one concave portion 123 defined between the protrusion 121 and the connection portion 122. In the embodiment as shown in FIG. 1, the number of the concave portion 123 is one and is a smooth concave curve. As shown in FIG. 2, a bottom point of the concave portion 123 of each cup 12 and a lowest point of the inside of each cup 12 is located on a straight line, the protrusion 121 protrudes above the straight line so as to cover the wearer's nipple. The cups 12 are able to raise the breasts and the concave portions 123 reduce the pressing or squeezing force to the breasts.

Figure 6:
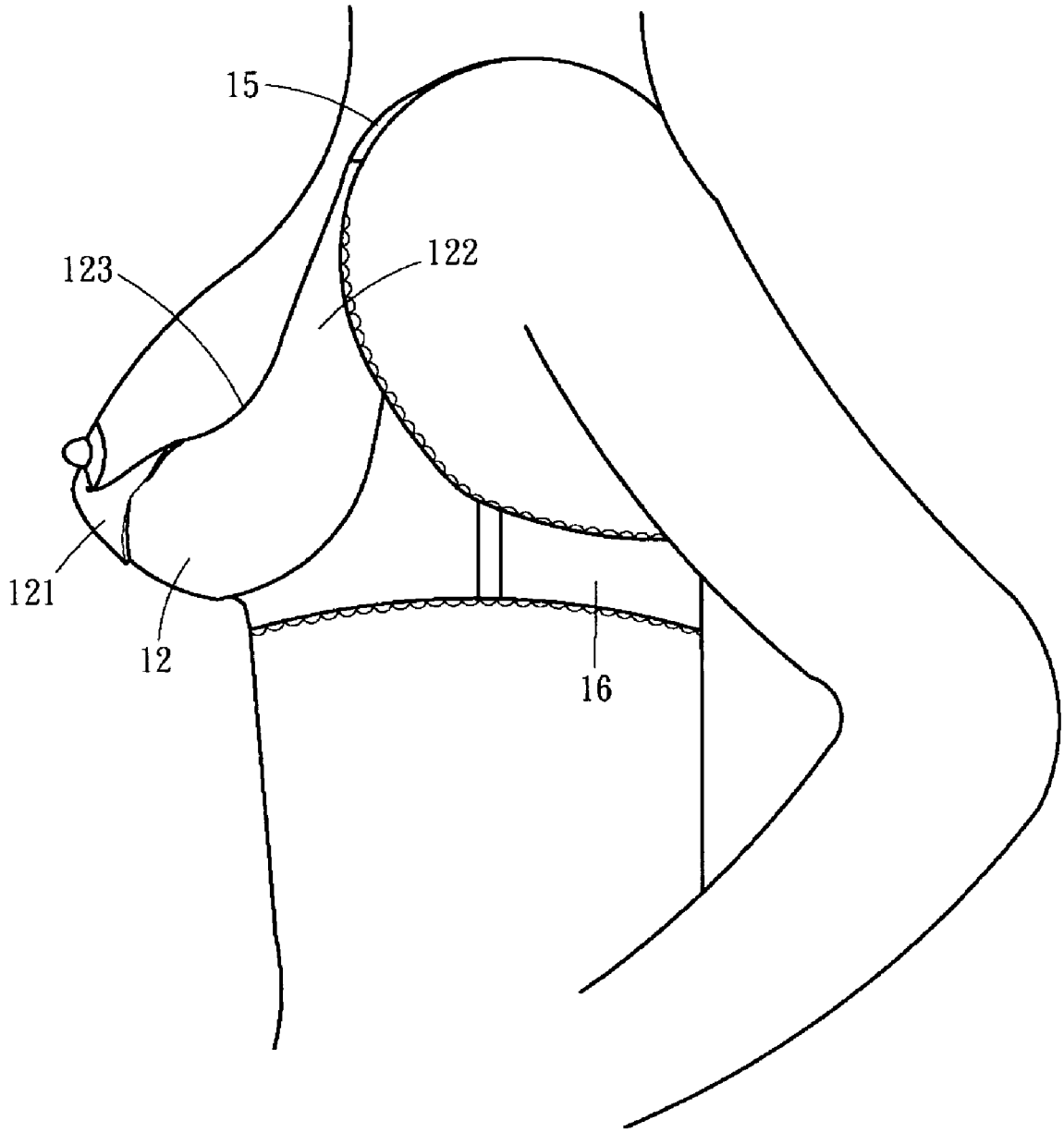
FIG. 6 shows that the nipple can be easily accessible by folding the protrusion outward.

As shown in FIG. 6, the bra 1 of the present invention can also be used as a maternity bra, wherein the protrusions 121 can be easily outward foldable so that the baby can easily access to the nipples.

Figure 7:
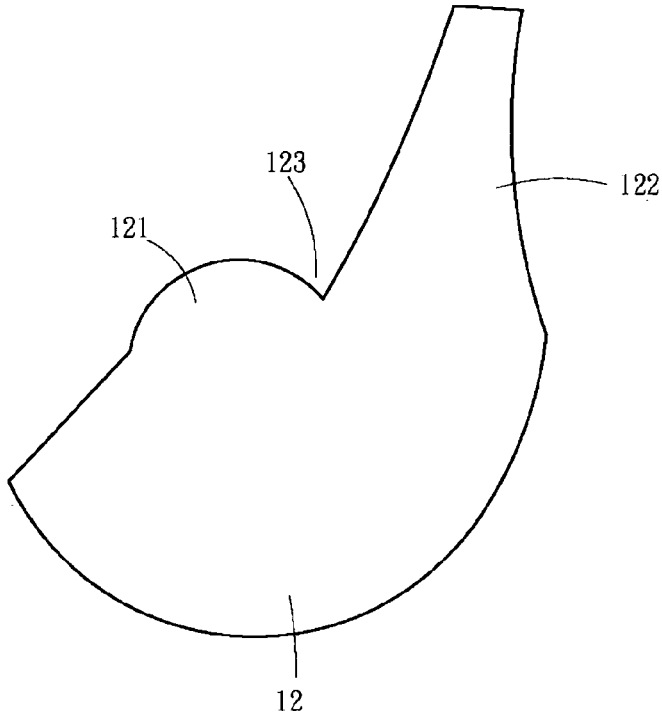
FIGS. 7 to 9 show several embodiments of the concave portion.
Figure 8:
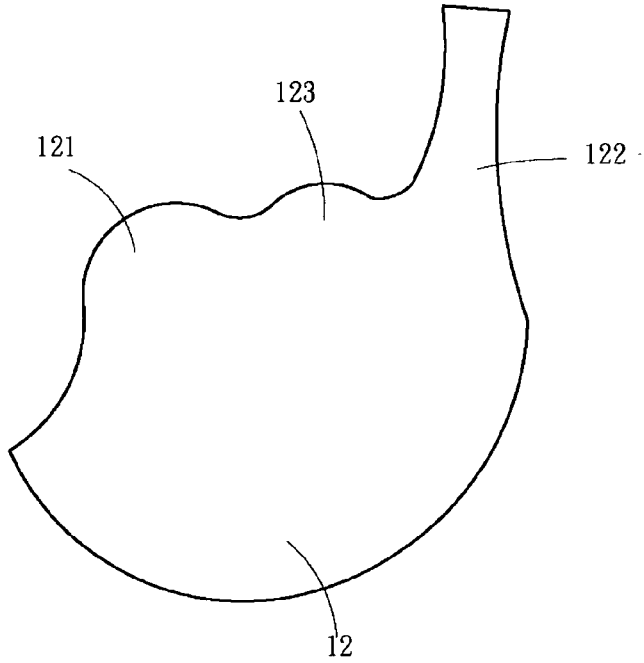
Figure 9:
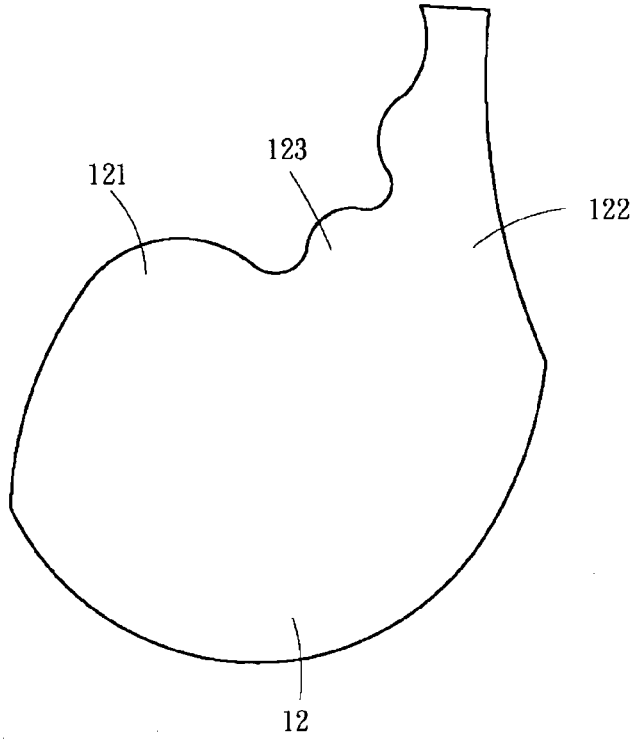
Figure 10:
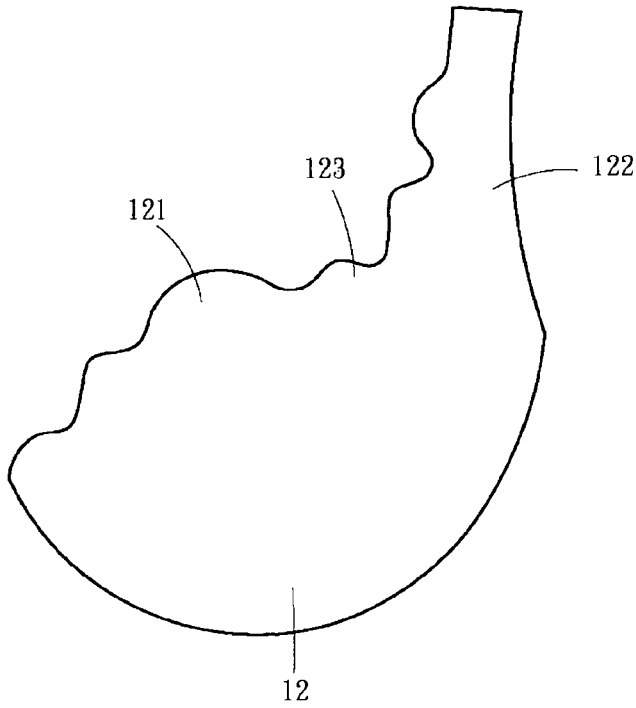
FIG. 10 shows yet another embodiment of the cup of the bra.
Figure 11:
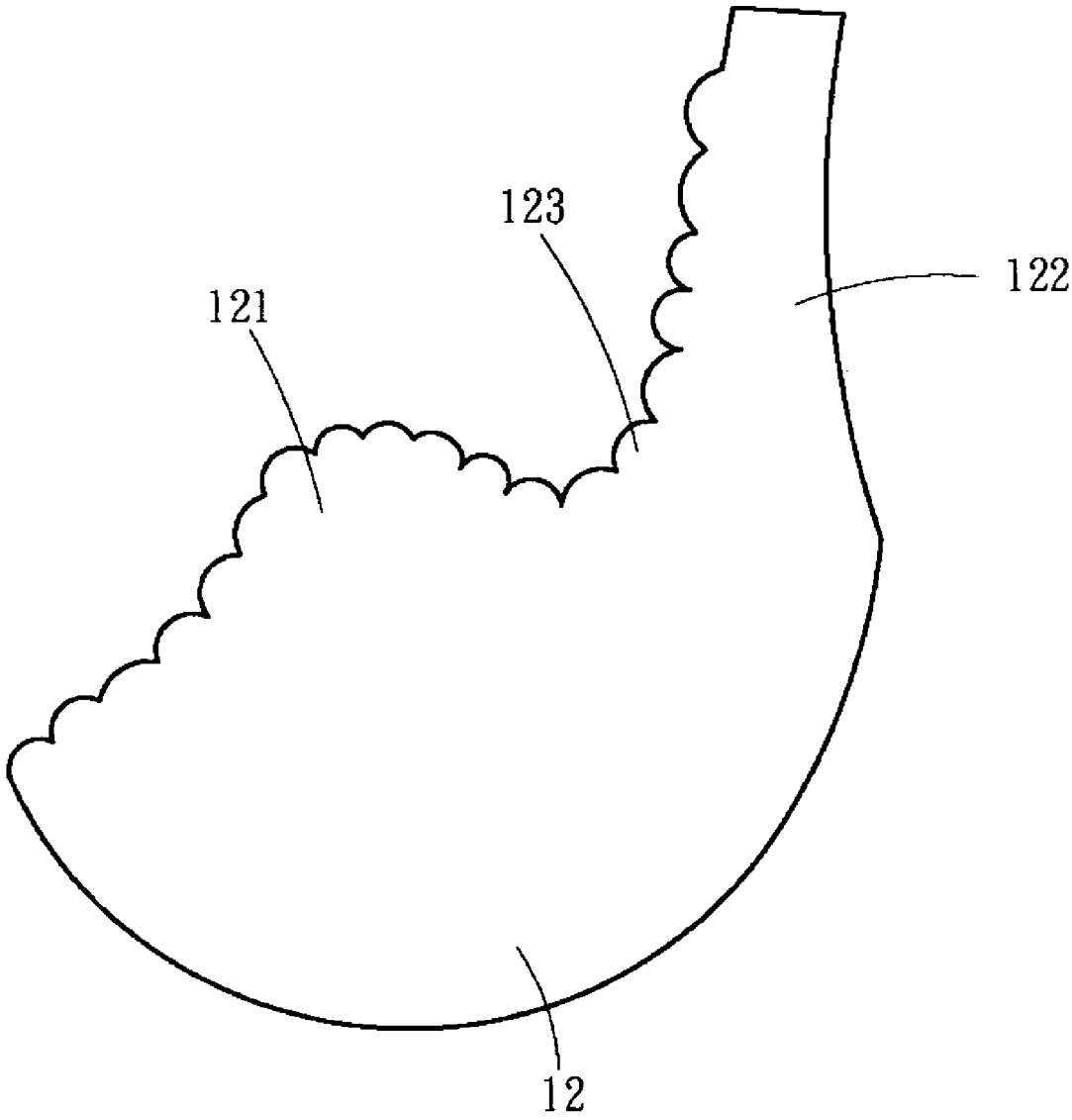
FIG. 11 shows that the top edge of the cap is wave shaped.
Figure 12:
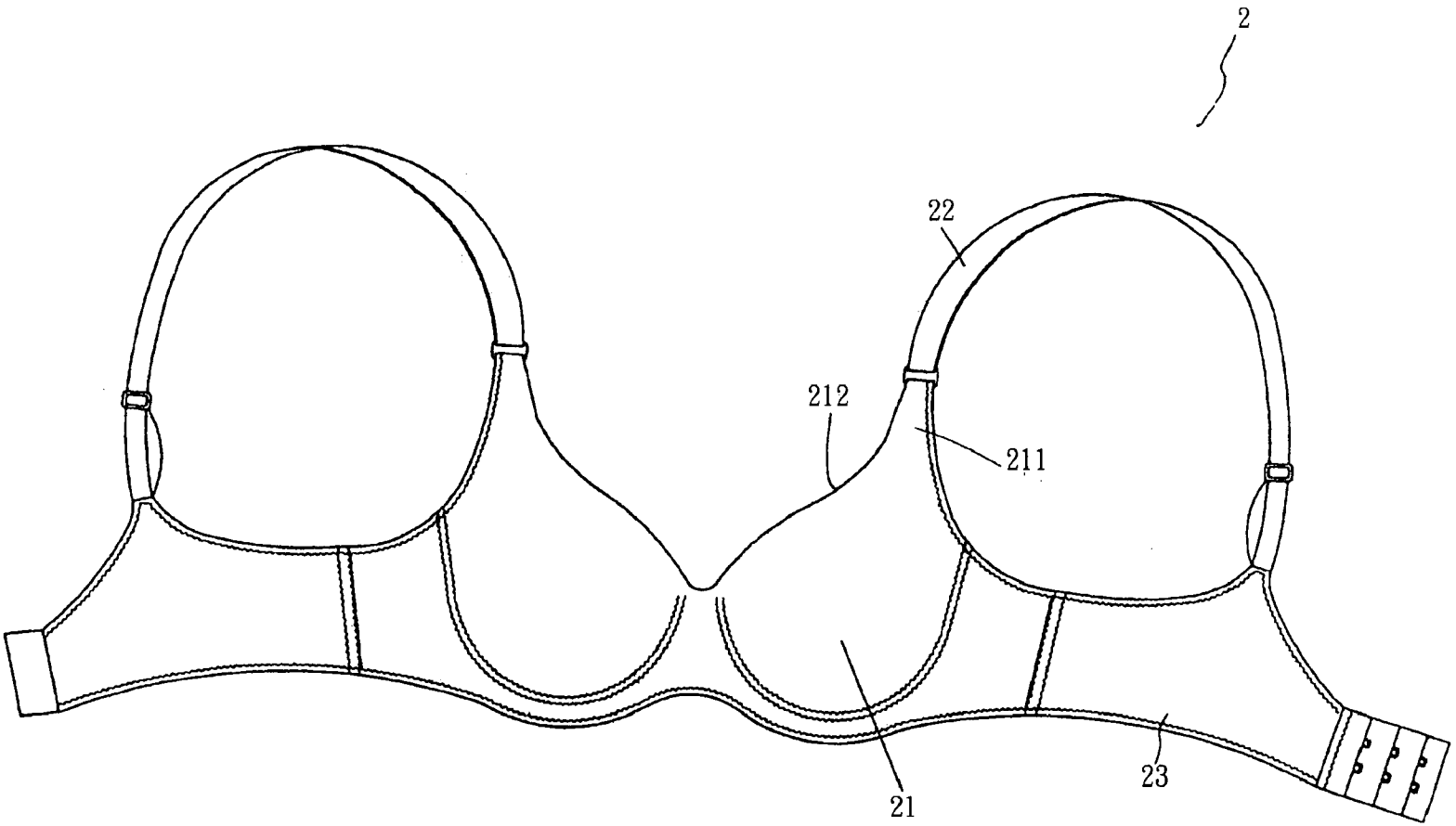
FIG. 12 PRIOR ART
FIG. 12 shows a conventional bra.
Figure 13:
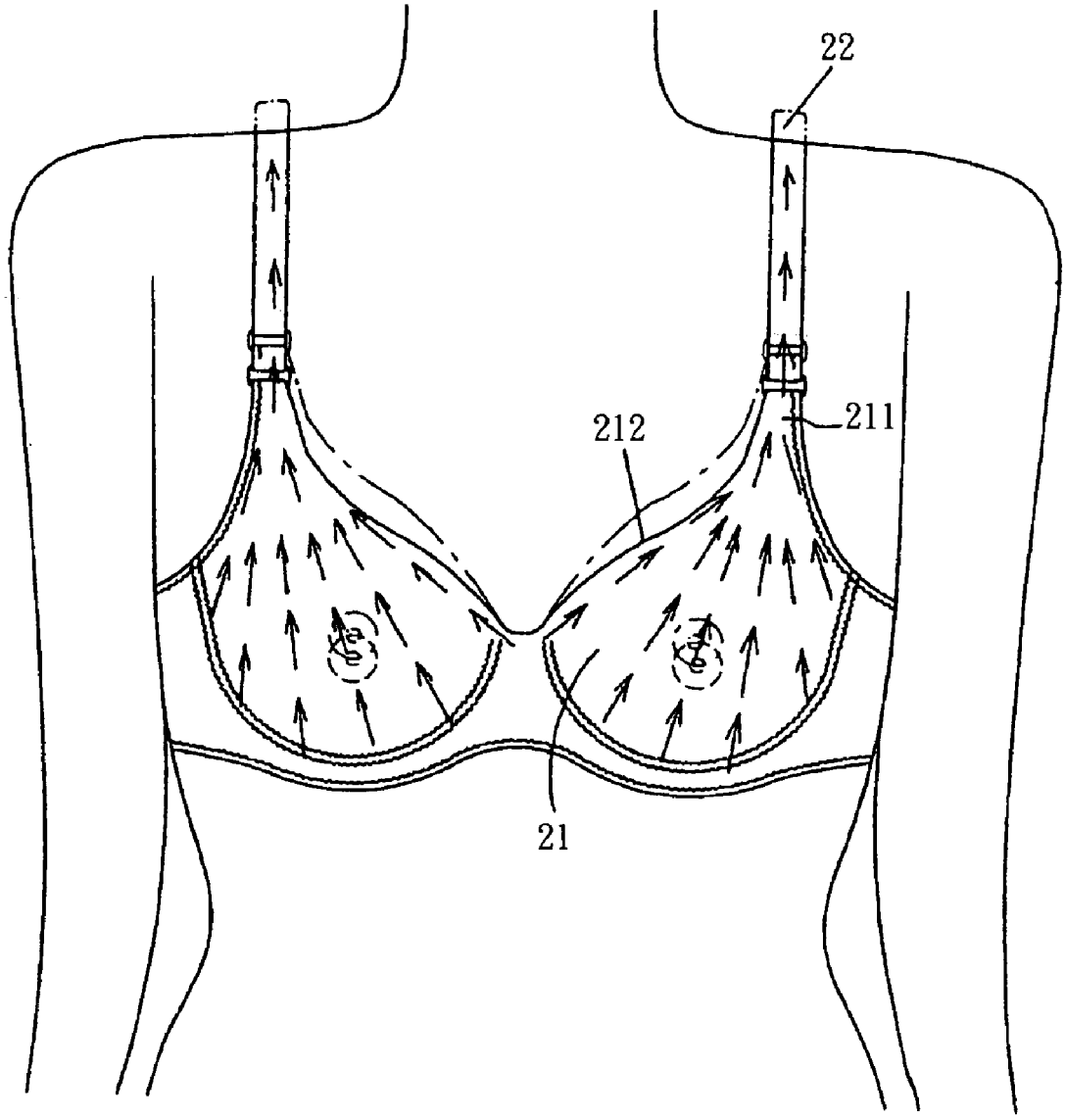
FIG. 13 PRIOR ART
FIG. 13 shows the breasts are lifted by wearing the conventional bra.
Figure 14:
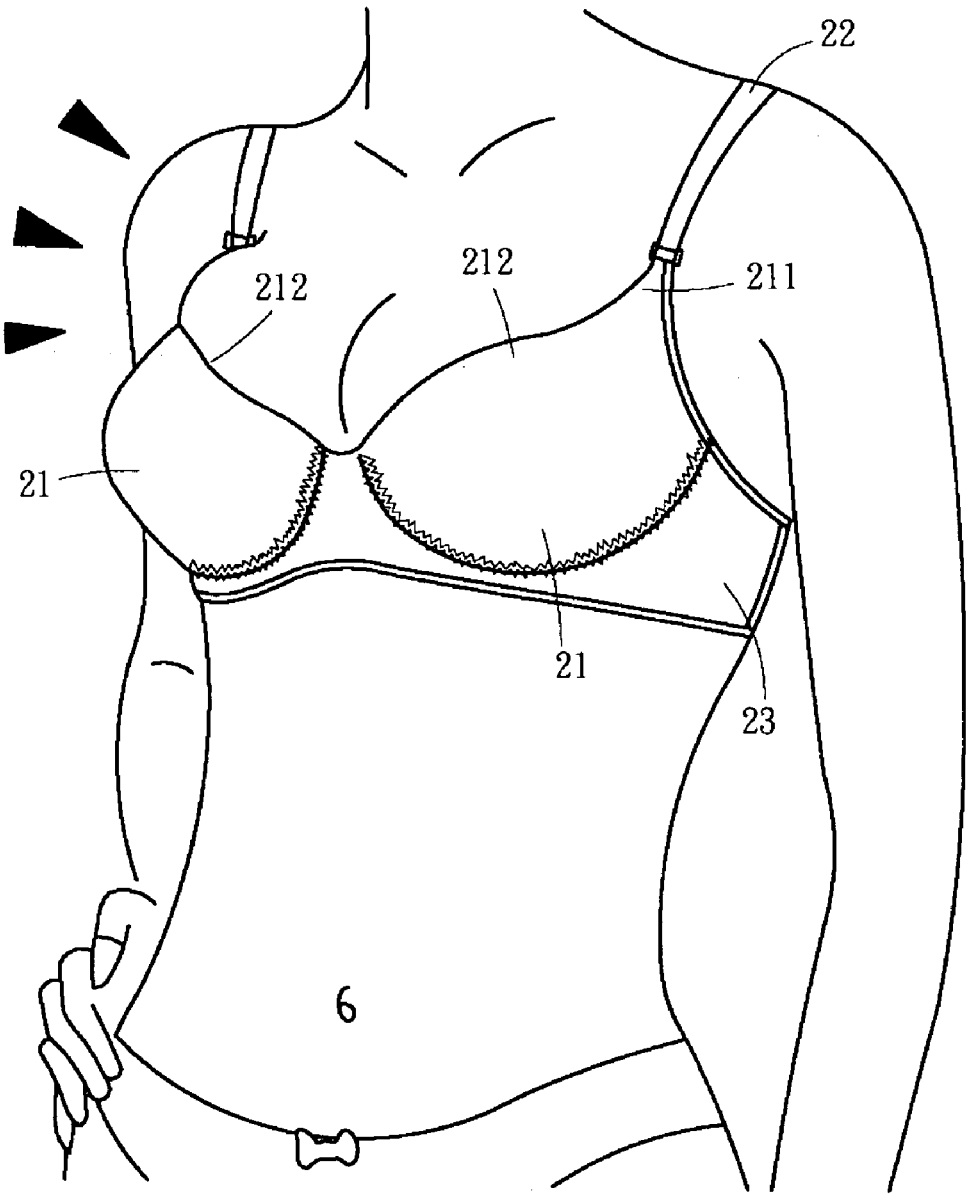
FIG. 14 PRIOR ART
FIG. 14 shows the top edges of the cups of the conventional bra press and squeeze the top portion of the breasts.
Figure 15:
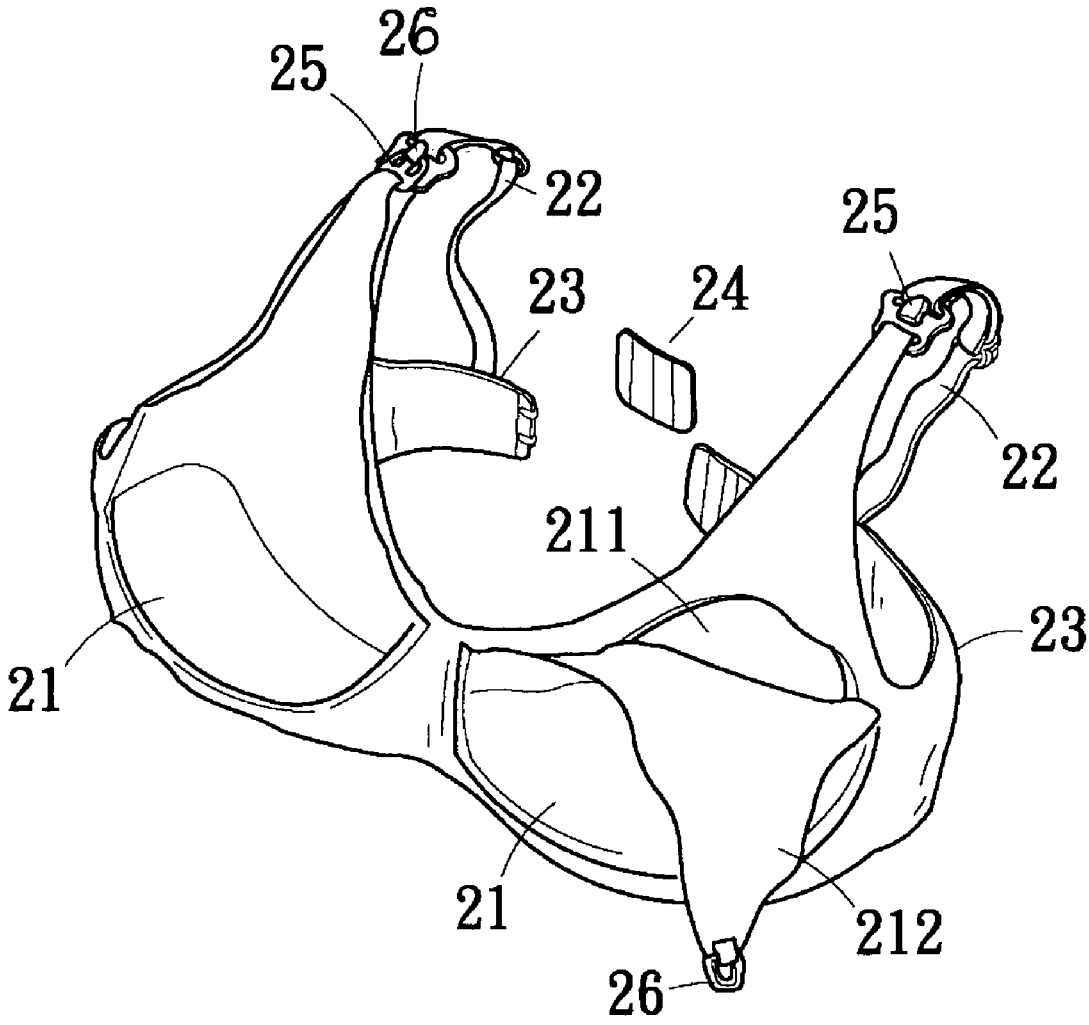
FIG. 15 PRIOR ART
FIG. 15 shows a conventional maternity bra.

FIG. 7 shows that each concave portion 123 is V-shaped and FIG. 8 shows that each concave portion 123 includes a bump portion located between two sub-concave portions. FIG. 9 shows that a bump portion is formed on an inside of the connection portion 122 as a decoration. FIG. 10 shows that the top edge of each cup 12 includes wave-shaped top contour, in other words, several wave-shaped bump portions are formed on the top edge of the cup 12 and the protrusion 121 is the highest among the bump portions. FIG. 11 shows that the top edge of each cup 12 including the protrusion 121 and the inside of the connection portion 122 include a plurality of bump portions.

While we have shown and described the embodiment in accordance with the present invention, it should be clear to those skilled in the art that further embodiments may be made without departing from the scope of the present invention.

What is claimed is:

1. A bra comprising:

two cups each including an inner end and an outer end, the inner ends of the cups being connected with each other, wherein each said inner end is positioned between the breasts of a wearer when the bra is worn by the wearer, each said cup further including a connection portion extending upwardly from the outer end thereof, each said cup further including a top edge, said top edge having a protrusion section formed on an intermediate portion of the top edge extending upwardly therefrom and spaced apart from the inner end of the cup; and two shoulder straps each having an end connected to the connecting portion of an associated one of the cups;

wherein each said protrusion section covers a nipple of a breast of a wearer when the bra is worn by the wearer; and wherein each said protrusion section is outwardly foldable to a position below the nipple of the wearer relative to a remaining portion of an associated one of the cups for revealing the nipple of the wearer without removing the cup from the breast of the wearer, each said protrusion section being formed of a resilient material wherein when said protrusion section is folded in a desired position said protrusion section maintains said desired position without the assistance of a continuous external force.

2. The bra as claimed in claim 1, wherein the cups are made by resilient and soft material.

3. The bra as claimed in claim 1, further comprising two side wraps respectively extending from the outer ends of the cups, each said shoulder strap having a second end connected to an associated one of the side wraps.

4. The bra as claimed in claim 1, wherein the protrusion of each said cup includes an outer end, each said cup further including a concave portion between the outer end of the protrusion section and the connection portion thereof.

5. The bra as claimed in claim 4, wherein each said concave portion is a smooth concave curve.

6. The bra as claimed in claim 4, wherein each said concave portion is V-shaped.

7. The bra as claimed in claim 4, wherein each said concave portion includes a bump portion located in an intermediate portion thereof.

8. The bra as claimed in claim 4, wherein a bottommost point of the concave portion of each said cup is located at a level substantially the same as a highest point of a mammary areola of the wearer.

9. A bra comprising:

two cups each including an inner end and an outer end, the inner ends of the cups being connected with each other, wherein each said inner end is positioned between the breasts of a wearer when the bra is worn by the wearer, each said cup further including a top edge, said top edge having a protrusion section formed on an intermediate portion of the top edge extending upwardly therefrom; and two side wraps respectively extending from the outer ends of the cup;

wherein each said protrusion section covers a nipple of a breast of a wearer when the bra is worn by the wearer; and wherein each said protrusion section is outwardly foldable to a position below the nipple of the wearer relative to a remaining portion of an associated one of the cups for revealing the nipple of the wearer without removing the cup from the breast of the wearer, each said protrusion section being formed of a resilient material wherein when said protrusion section is folded in a desired position said protrusion section maintain said desired position without the assistance of a continuous external force.

10. A bra cup comprising:

an inner end;

an outer end;

a top edge; and a protrusion section formed on an intermediate portion of the bra cup top edge extending upwardly therefrom;

wherein the protrusion section covers a nipple of a breast of a wearer when the bra cup is worn by the wearer, wherein the protrusion section is outwardly foldable to a position below the nipple of the wearer relative to a remaining portion of the bra cup for revealing the nipple of the wearer without removing the bra cup from the breast of the wearer, the protrusion section being formed of a resilient material wherein when said protrusion section is folded in a desired position said protrusion section maintain said desired position without the assistance of a continuous external force.

* * * * *